US006000624A

United States Patent [19]

Marron

[11] Patent Number: 6,000,624

[45] Date of Patent: Dec. 14, 1999

[54] MITER RAIL SYSTEM

[76] Inventor: Gerald I. Marron, 17 Vassar Rd., Broomall, Pa. 19008

[21] Appl. No.: 09/045,619

[22] Filed: Mar. 20, 1998

[51] Int. Cl.[6] ..... E01B 11/00

[52] U.S. Cl. ..... 238/174; 238/225

[58] Field of Search ..... 238/174, 183, 238/184, 218, 225, 226, 230, 243, 244, 246, 250, 251, 258

[56] References Cited

U.S. PATENT DOCUMENTS 1,041,403 10/1912 Bacon ..... 238/225
1,186,737 6/1916 Bohannan ..... 238/174
1,378,425 5/1921 Rosebrook ..... 238/174
1,665,906 4/1928 Bohannan ..... 238/174

*Primary Examiner*—Mark T. Le
*Attorney, Agent, or Firm*—Duane, Morris & Heckscher LLP

[57] ABSTRACT

A miter rail system for spanning a railroad track joint including a fixed rail, a lift rail and a rider rail connected to the fixed rail. The rider rail has an upper surface including a central portion defined by an arc of constant radius and opposite end portions. The apex of the central portion is greater in height than the height of the fixed rail and lift rail, and the height of the opposite end portions at opposed end faces of the rider rail is sufficiently low to avoid contact by a rolling stock wheel.

18 Claims, 8 Drawing Sheets

R'

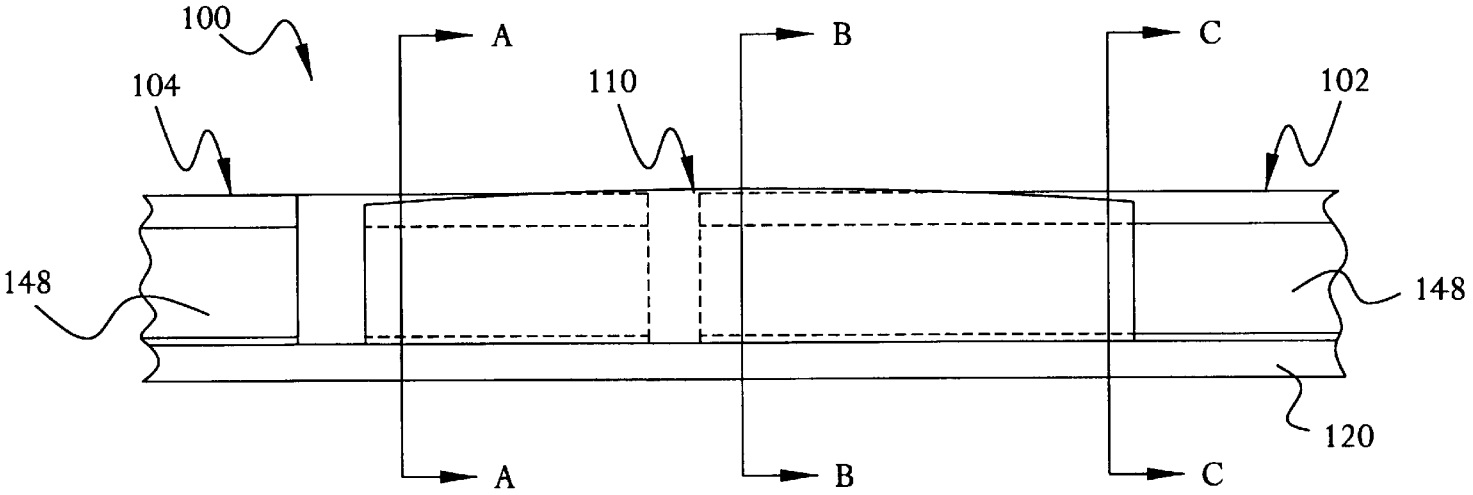
FIG. 5
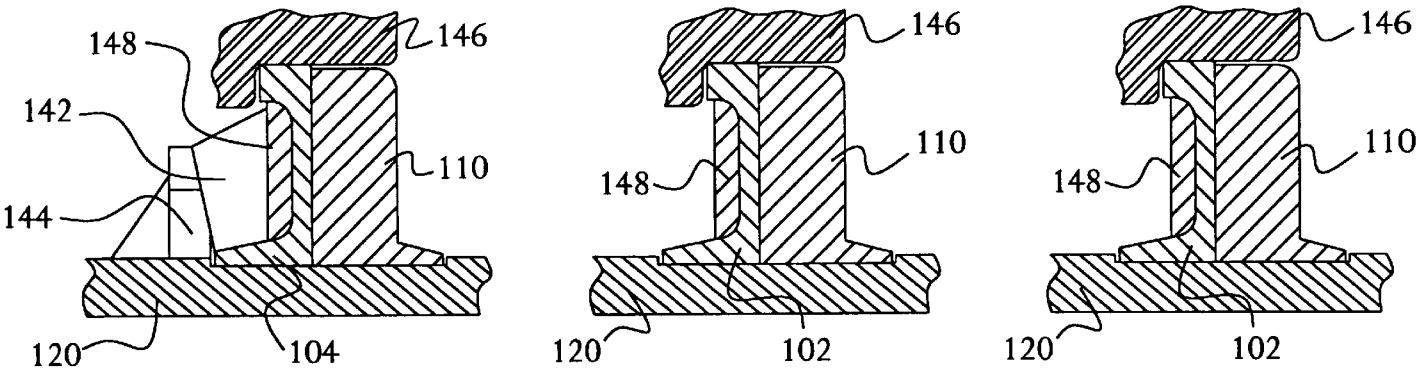
FIG. 6A
FIG. 6B
FIG. 6C

MITER RAIL SYSTEM

FIELD OF THE INVENTION

The present invention relates in general to railway track joints and in particular to track joint systems between stationary and vertically movable track sections.

BACKGROUND OF THE INVENTION

Railroad bridges are frequently erected over waterways trafficked by pleasure boats, merchant ships or military vessels. The superstructures or equipment carried by the superstructures of these craft are sometimes quite high with respect to the water surface and may extend above the elevation of a railroad bridge deck. Several types of railroad bridges have movable decks to permit passage of tall vessels as the need arises. Although their methods of operation may vary, such bridges possess at least one characteristic in common. That is, at least a portion of the bridge deck may be selectively disposed into a first position for permitting passage of rolling stock thereover and a second position for permitting passage of watercraft by or under the deck. Included among these classes of bridges are the vertical lift bridge, the bascule bridge and the swing bridge. A vertical lift bridge normally includes a pair of towers disposed on opposite ends of a bridge deck which include machinery for raising and lowering the deck while maintaining the deck in substantially horizontal orientation. A bascule bridge typically includes a bridge deck pivotally connected about a horizontal pivot axis to a bridge approach, pier, or the like, such that the deck may swing upwardly and downwardly. In a swing bridge, the deck is generally supported atop a turntable and rotates approximately 90° in a substantially horizontal plane between rail passage and watercraft passage positions.

Steel rail or track is subject to thermal expansion and contraction. Accordingly, a certain gap must be maintained between the ends of rails or tracks carried by a movable bridge deck and the ends of adjacent rails or track. Depending on the atmospheric temperature range to which the bridge is likely to be exposed and the length of rails involved, the required gap may range from about one to three inches or more. However, traverse of gaps of this magnitude by the wheels of rolling stock is not recommended because of the potential for wheel and/or track damage and possible derailment of the rolling stock.

Miter or rider rails are transition rails used to bridge the gap between adjacent ends of a section of vertically movable track and a section of stationary track known as the "running rails". CMI-Promex, Inc. of Pedricktown, N.J. manufactures a miter rail system including a rider rail approximately three feet in length which is bolted to an end of the stationary rail and spans the distance between the ends of the stationary and movable rails. The rider rail has a convex upper surface of constant radius whereby the upper surface of the rider rail is slightly lower than the running rails at its ends and slightly higher than the running rails at its center.

As the wheels of rolling stock travel over a running rail and encounter the rider rail they become supported by the rider rail and slightly lifted with respect to the upper surfaces of the running rails. Upon passing the rider rail, the wheels come into contact with the upper surface of the running rail at the downstream side of the track joint.

As is known, rolling stock wheels have two rail contacting surfaces, the "flat" and the "flange". The flat contacts the upper surface of the head portion of rail or track. the flange extends substantially perpendicular to the flat and contacts the substantially vertical inner face of the head portion of the rail. The flat bears the majority of the weight of the rolling stock and the flange functions to keep the wheels in engagement with the track. To enhance reliable contact between the rolling stock wheels with the underlying track, the opposed rails of the track are usually installed slightly off vertical. More particularly, each of the rails is canted or tilted slightly inwardly toward the other at approximately 1.5° from vertical.

The upper end edges or corners of the rider rails of miter rail systems such as the aforementioned CMI-Promex, Inc. system frequently become chipped off during use. The chipped areas, in turn, promote the generation and promulgation of cracks that reduce the structural integrity of the rider rails. Although the chipping damages is believed to be caused by contact with rolling stock wheels, the manner by which the rider rail ends become damaged is not fully understood, especially since the upper surfaces of the rider rails at the end regions thereof are lower in elevation than the adjacent running rails.

An advantage exists, therefore, for a miter rail system including a rider rail which is resistant to damage resulting from contact with rolling stock wheels.

SUMMARY OF THE INVENTION

The present invention provides a rider rail adapted for use in a miter rail system which is resistant to damage resulting from contact with rolling stock wheels. The rider rail is an elongate member of generally similar height to the running rails with which it operates. The rider rail is bolted to the outer side of a stationary running rail of the miter rail system and has an upper surface including a plurality of surface portions of differing configuration.

The rider rail has an upper surface including a convex central surface portion bound by first and second end surface portions having surface configurations different from the central surface portion. According to a presently preferred embodiment, the convex central surface portion is defined by an arc having a large and preferably constant radius of curvature and the first and second end surface portions are formed to present heights at the end faces of the rider rail sufficiently low to avoid being contacted by the wheels of passing rolling stock. Consequently, the ends of the rider rail experience less and chipping than currently available designs which serves to prolong the service life of the rider rail.

Other details, objects and advantages of the present invention will become apparent as the following description of the presently preferred embodiments and presently preferred methods of practicing the invention proceeds.

BRIEF DESCRIPTION OF THE DRAWINGS

The invention will become more readily apparent from the following description of preferred embodiments thereof shown, by way of example only, in the accompanying drawings wherein;

FIG. 5 is an enlarged side elevation view, with certain elements omitted for clarity, of a miter rail system according to the present invention;

FIG. 6A is a cross-section view taken along line A—A of FIG. 5 depicting the miter rail system bearing a rolling stock wheel;

FIG. 6B is a cross-section view similar to FIG. 6A taken along line B—B of FIG. 5;

FIG. 6C is a cross-section view similar to FIG. 6A taken along line C—C of FIG. 5;

DETAILED DESCRIPTION OF PREFERRED EMBODIMENTS

Figure 1:
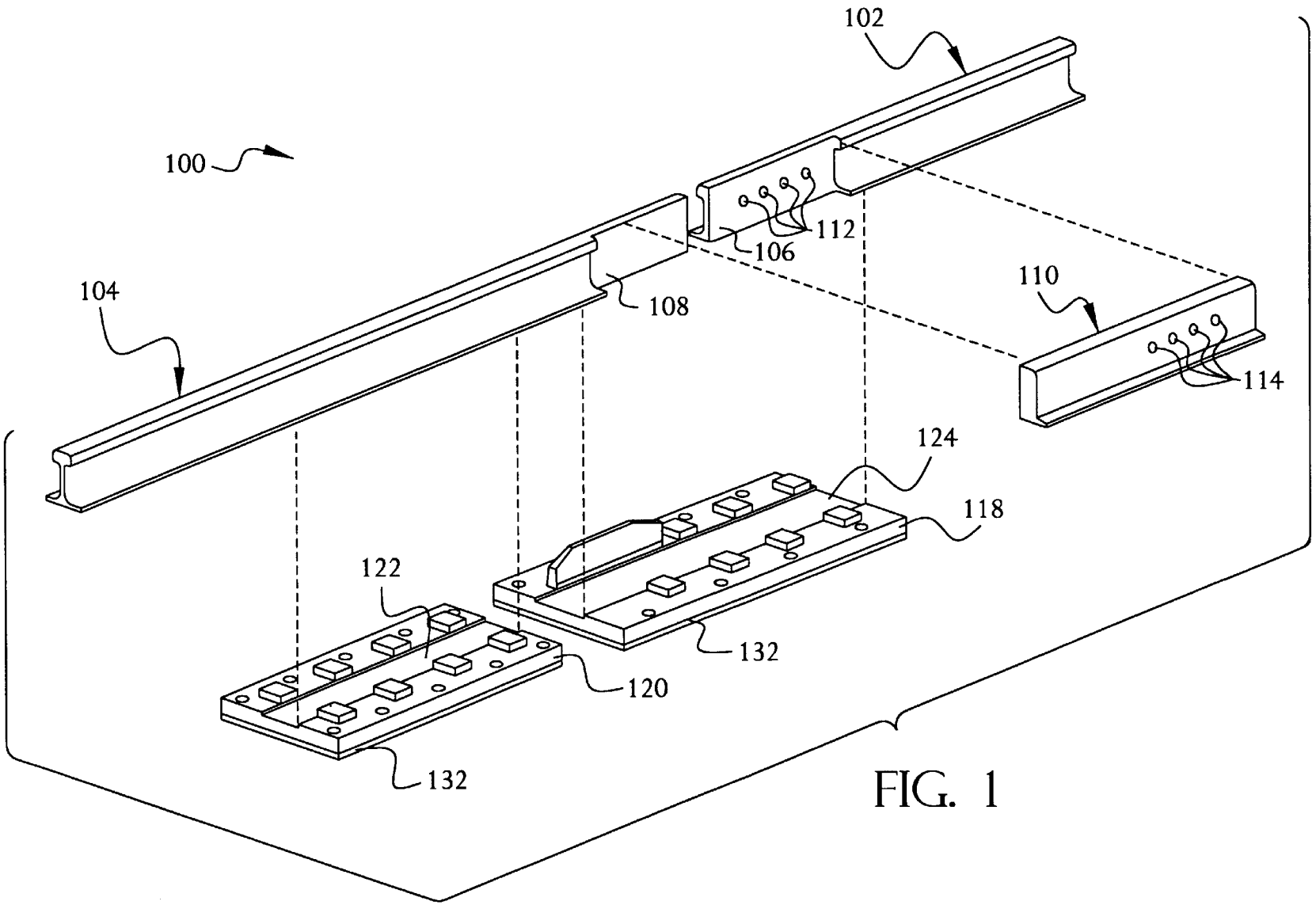
FIG. 1 is an exploded, isometric view of a miter rail system in accordance with the present invention.
Figure 2:
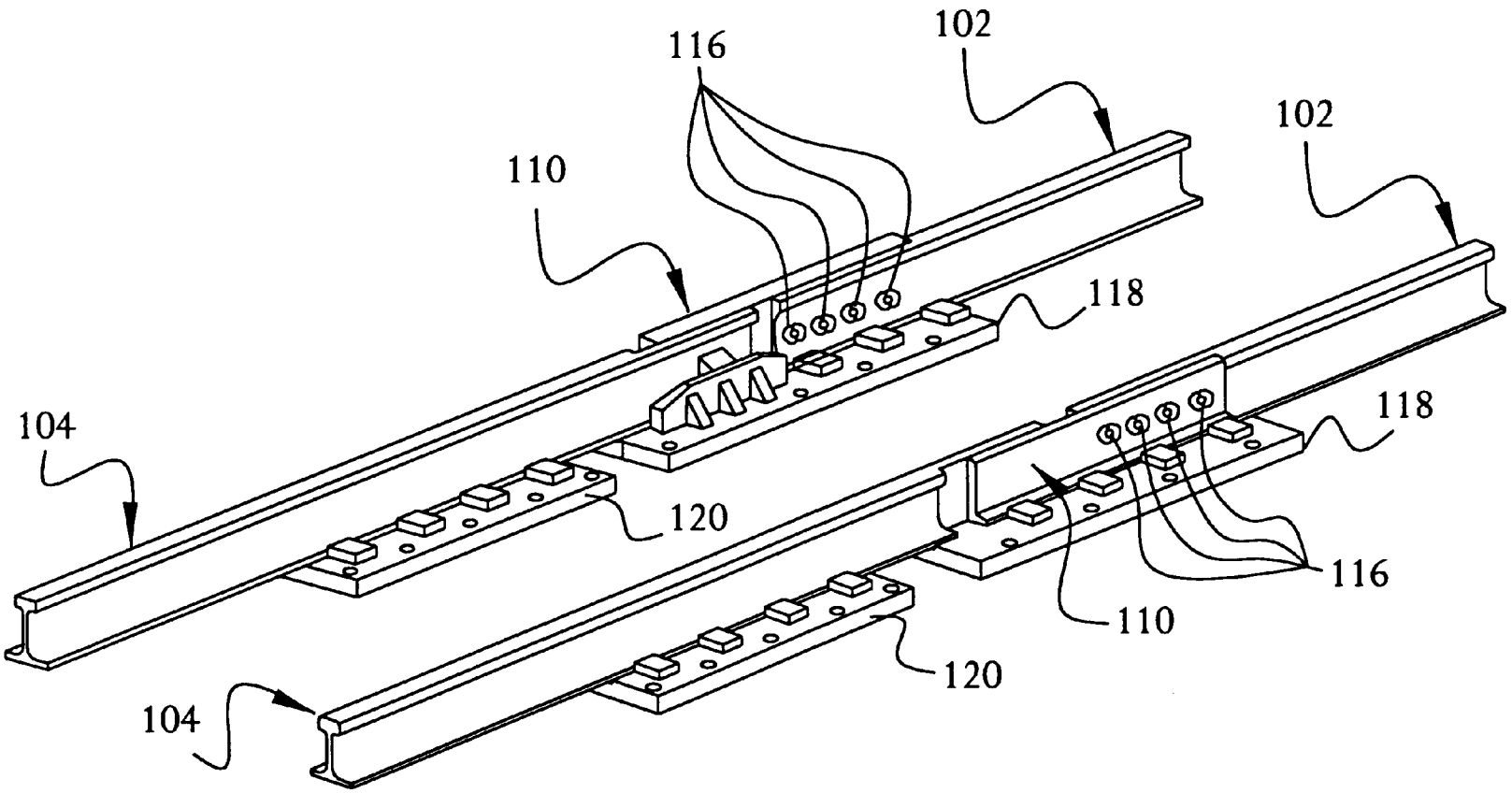
FIG. 2 is an isometric view of a pair of railroad tracks including the miter rail system of FIG. 1 in assembled condition.
Figure 3:
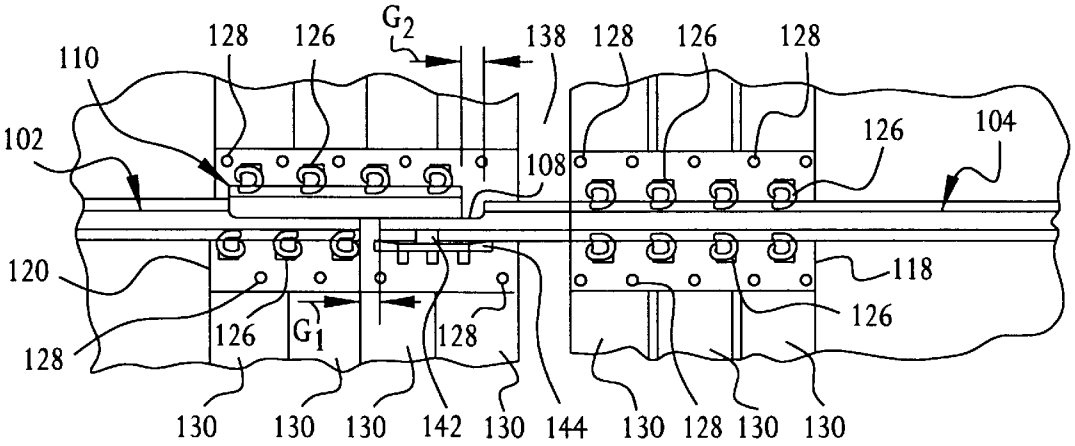
FIG. 3 is a top plan view of a first railway track joint installation employing a miter rail system according to the present invention.
Figure 3A:
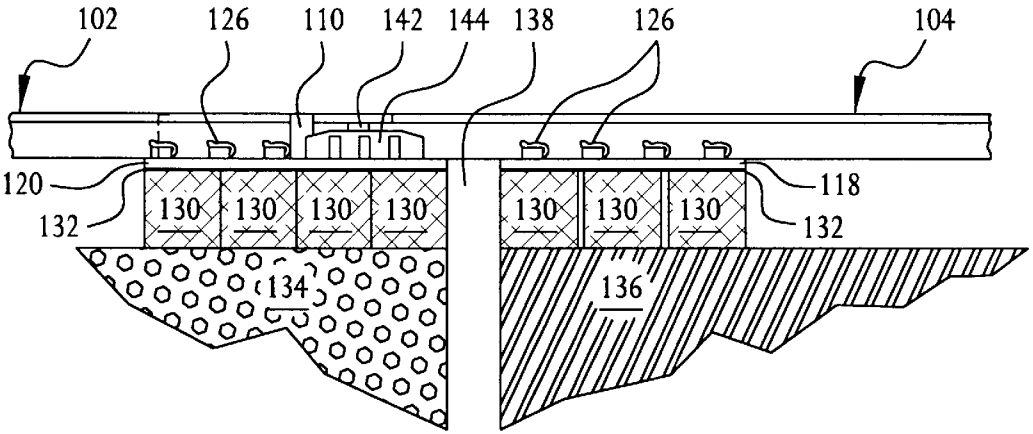
FIG. 3A is a side elevation view of the track joint installation and miter rail system shown in FIG. 3.

Referring to FIGS. 1 and 2 collectively, there is shown a miter rail system according to the present invention, identified generally by reference numeral 100, for bridging a railway track joint between stationary and vertically movable track sections. System 100 comprises a length of conventional rolling stock rail 102, hereinafter referred to as the "fixed" running rail. System 100 further includes another length of conventional rolling stock rail 104 hereinafter referred to as the "lift" running rail. The fixed and lift rails 102, 104 may be any standard size rail, e.g., 132 or 136 lb. R.E. #1 rail, which is preferably heat treated to achieve a Brinnell hardness of about 321 to 388. As will be described more fully hereinafter, lift rail 104 is capable of vertical movement whereas fixed rail 102 remains stationary.

The outwardly facing sides of adjacent ends of running 10 rails 102, 104 are machined to a depth and distance to establish notches 106 and 108, respectively, suitable to accommodate a rider rail 110 constructed in accordance with the present invention. Rider rail 110 is preferably about 33 to about 40 inches in length and is generally boot-shaped in cross-section. As discussed in greater detail with regard to FIG. 10, the height of rider rail 110 is variable in relation to the height of running rails 102, 104. According to a presently preferred embodiment, rider rail 110 is fabricated from S.A.E. 4140 steel hardened to a Brinnell hardness of about 444 to 534. Fixed rail 102 and rider rail 110 are preferably provided with a plurality of through-bores 112 and 114, respectively, which are adapted to receive elongate fastening means 116 such as self-locking nut and bolt assemblies or the like, for affixing the rider rail to the notch 106 of the fixed rail.

The fixed rail 102 and the lift rail 104 are respectively attached to at least one fixed rail plate 118 and at least one lift rail plate 120. Rail plates 118, 120 are preferably made from A.S.T.M. A-36 steel of sufficient thickness, e.g., about 1⅜ to about 1⅝ inches, to withstand the loads normally encountered by rolling stock traffic and suitable peripheral dimensions to accommodate the ends of rails 102 and 104. Lift rail plate 120 is desirably provided with a shallow and slightly sloped longitudinal groove 122 having width sufficient to receive the bases or feet of the notched ends of the fixed and lift rails 102, 104 and the base or foot of rider rail 110.

Referring to FIGS. 3, 3A, 4 and 4A, rails 102, 104, 110 may be affixed to the appropriate rail plate 118, 120 by any suitable fastening means 126, e.g., Pandrol 2055 "e" shaped rail clips. Rail plates 118, 120 are also preferably provided with a plurality of through-bores 128 adapted to receive unillustrated spikes or similar fasteners for securing the plates to underlying conventional railroad ties 130. Preferably, a vibration dampening means 132 is disposed between the undersurfaces of the rail plates 118, 120 and ties 130. A presently preferred material for dampening means 132 is an approximately ½" thick high durometer neoprene sheet or the like. Railroad ties 130, in turn, are supported by one or the other of a fixed structure 134 and a movable structure 136 disposed on opposite sides of a track joint 138. Stationary structure 134 may be a roadway, a bridge pier or other fixed railway support structure, and movable structure 136 may comprise all or a portion of a movable bridge deck associated with a vertical lift bridge, a bascule bridge, a swing bridge and the like. For example, the movable structure 136 shown in FIGS. 3 and 3A may be either the deck of a vertical lift bridge or a bascule bridge. In the event movable structure 136 is a vertical lift bridge, opposite ends of the movable structure would be raised and lowered by suitable machinery, not illustrated, to permit passage thereunder of tall watercraft. If, however, the movable structure 136 were the deck of a bascule bridge, the unillustrated end of movable structure 136 opposite track joint 138 would be pivotally secured about a horizontal axis and driven by suitable unillustrated machinery to swing the movable structure 136 upwardly and downwardly with respect to fixed structure 134 to selectively permit passage of tall vessels.

Figure 4:
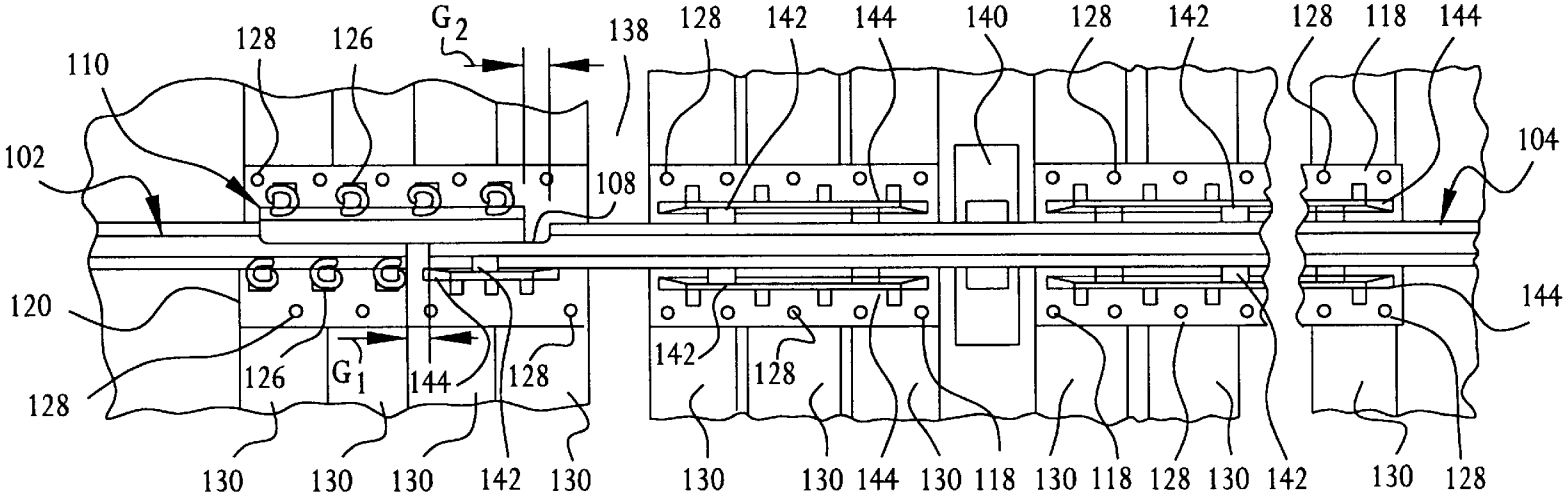
FIG. 4 is a top plan view of a further railway track joint and installation employing a miter rail system according to the present invention.
Figure 4A:
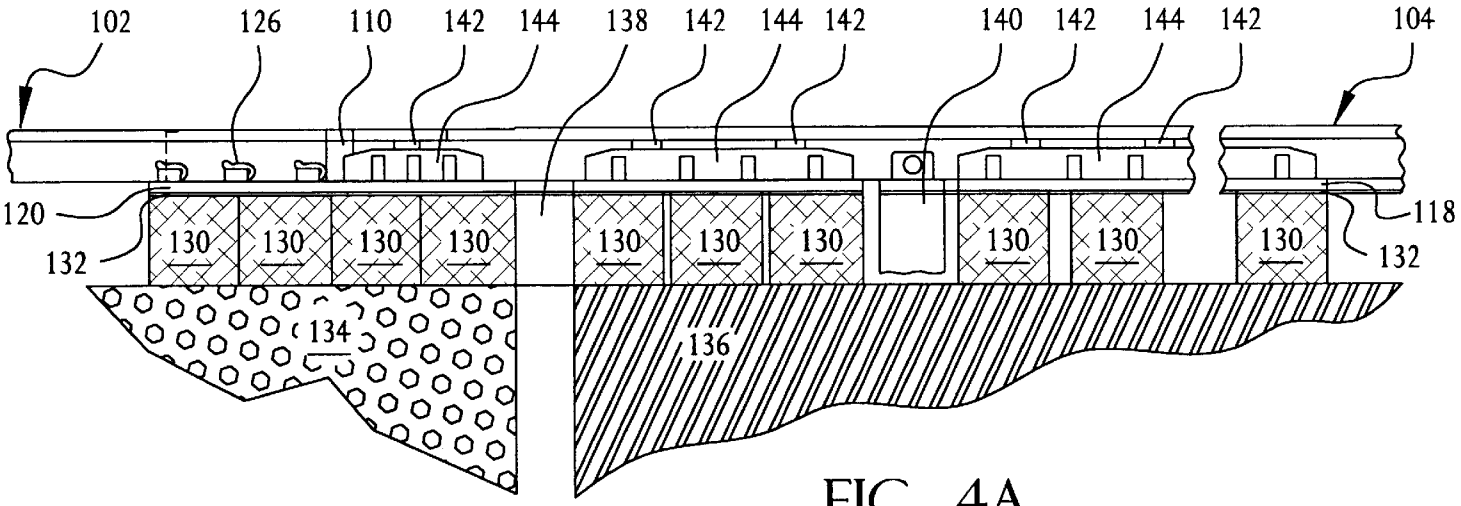
FIG. 4A is a side elevation view of the track joint installation and miter rail system shown in FIG. 4.

Alternatively, as shown in FIGS. 4 and 4A, movable structure 136 may be a bridge deck (or a portion thereof) which is supported by a turntable (not shown) of a swing bridge. In this case, only the end of the lift rail 104 must be lifted.

More particularly, the end of lift rail 104 must be raised to a height sufficient to clear the rider rail 110. Suitable lift means 140 such as directly or indirectly driven mechanical, pneumatic, hydraulic lift devices may be provided on movable structure 136 near the track joint 138 to achieve the desired lifting of the lift rail 104. In the embodiment shown in FIGS. 4 and 4A, the lift rail 104 is unattached to the lift rail plates 118. Because of the inherent flexibility and lengths of rail involved, lift rail 104 may be repeatedly lifted and lowered by lift means 140 without experiencing meaningful fatigue. Once the lift rail 104 is sufficiently lifted to clear the rider rail 110, the movable structure 136 may be turned approximately 90° by suitable turntable drive machinery to permit passage of a tall water vessel. Once the vessel has passed, the turntable returns the movable structure 136 to its original position and the lift means 140 lowers the lift rail 104 whereby rolling stock may again pass over the bridge.

To assure proper alignment of the fixed rail 102 with lift rail 104 and rider rail in FIGS. 4 and 4A, a plurality of guide blocks 142 are welded or otherwise fixedly secured at spaced intervals along either the inner face, the outer face, or more preferably, both the inner and outer faces of the lift rail 104. Guide blocks 142 are adapted to cooperate with upstanding guide shoes 144 affixed to lift rail plates 118. In each of the embodiments represented in FIGS. 3, 3A, 4 and 4A, a guide block 142 is preferably provided on the inner face of the lift rail in the region adjacent notch 108 which cooperates with a guide shoe 144 secured to the fixed rail plate 120 to maintain the notch 108 in precise alignment with rider rail 110.

In the installations shown in FIGS. 3, 3A, 4 and 4A, lift rail 104 spans the track joint 138 such that its notched end 108 substantially matingly receives the end of rider rail 110 projecting from the end of the fixed rail 102. Depending on the expected range of temperature under which the miter rail system of the present invention is to be exposed, the tips of fixed and lift rails 102, 104 should be disposed at a minimum gap $G_1$, of about one to about three inches. An additional gap $G_2$ of about three to about four inches should be maintained between the tip of the rider rail 110 and the unnotched portion of the lift rail 104 to permit free passage of the lift rail relative to the rider rail under all temperatures likely to be experienced by the bridge.

FIG. 5 is an enlarged view of an outwardly facing side of a railroad track incorporating the miter rail system 100 in accordance with the present invention. FIGS. 6A, 6B ad 6C represent sections taken along lines A—A, B—B and C—C, respectively, of FIG. 5 and depict how the present miter rail system supports a rolling wheel as it travels from left to right with respect to FIG. 5.

FIG. 6A depicts the disposition of a rolling stock wheel 146 as it begins passage over the rider rail 110. At this point, wheel 146 is supported by the upper surface of lift rail 104 because, at its opposite end regions, rider rail 110 is lower in height than the adjacent running rails 102, 104. FIG. 6A also reveals a presently preferred construction and arrangement of the aforementioned guide block 142 and guide shoe 144. Additionally, FIG. 6A as well as FIGS. 6B and 6C illustrate that the webs of the notched areas of the fixed and lift rails 102 are preferably fitted with steel reinforcement plates 148 which are secured by fasteners 116 (FIG. 2) to the respective fixed or lift rail 102, 104 and rider rail 110. Plates 148 buttress the machined webs of the ends of the fixed and lift rails 102, 104 against collapsing under the weight of passing rolling stock. Similar reinforcement plates 148 are also preferably provided on at least one or, more preferably, both, sides of the webs of the fixed and lift rails 102, 104 adjacent the notched areas thereof.

FIG. 6B illustrates the disposition of rolling stock wheel 146 at substantially the apex of the rider rail 110. At this point, wheel 148 is supported by the upper surface of the rider rail because at this site and for the majority of the length of the rider rail, the rider rail is higher in height than the running rails 102, 104. FIG. 6C shows the disposition of rolling stock wheel 146 just prior to its passing of rider rail 110. At this point, wheel 146 is supported by the upper surface of the fixed rail 102. It will be understood that the descriptions of FIGS. 6A–6C would be reversed for a rolling stock wheel traveling from right to left with respect to FIG. 5.

Figure 7:
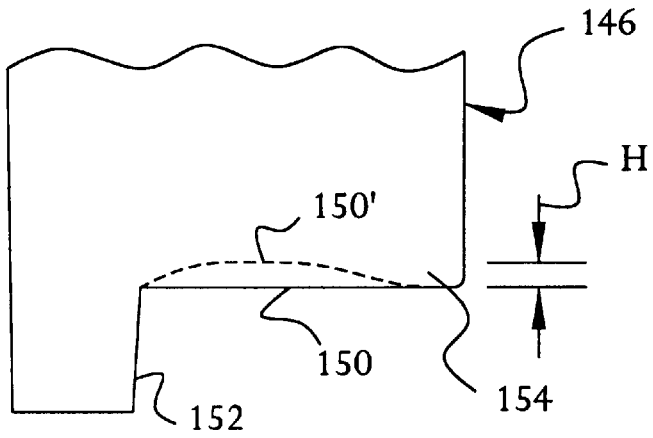
FIG. 7 is an enlarged view of the rail contact surfaces of a rolling stock wheel.
Figure 8:
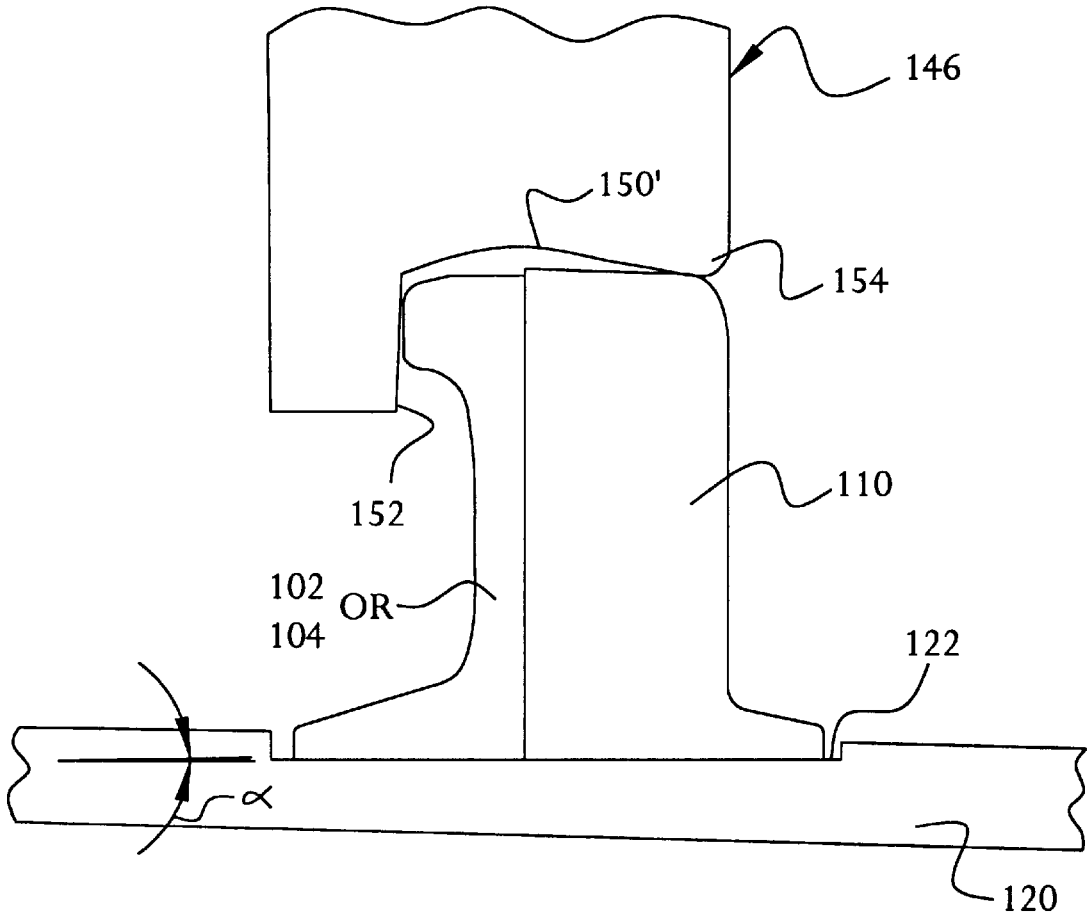
FIG. 8 is an enlarged view of the rail contact surfaces of a rolling stock wheel in contact with the rails of a miter rail system.

FIG. 7 illustrates an enlarged partial section profile of the flat 150 and flange 152 rail contacting surfaces of a typical rolling stock wheel 146. During its service life, a rolling stock wheel may become worn in the flat portion 150 of the wheel. A commonly observed wear pattern in this area generally resembles a concave groove as indicated by dashed line 150'. As a consequence of this groove, the outer edge of the flat opposite the flange 152 assumes the form of a slightly raised continuous ridge 154 known as a "false flange". Depending on the quality of the wheel, the height H of false flange 154 may range from essentially zero up to about ¼ inch. Although it has not been directly observed by the present inventor, it may be that the false flange 154 formed by wear and tear of the rolling stock wheel is of sufficient height to strike and chip the upper end edges of the rider rails. As shown in FIG. 8, the longitudinal groove of lift rail 120 is preferably inclined toward the inner face of running rails 102, 104 by an angle of approximately 1.5°. This slope is consistent with standardized rail installation specifications and is provided so as to incline the upper surfaces of the rails 102, 104, 110 inward by approximately 1.5° from vertical and thereby enhance engagement of the flange portion 152 of rolling stock wheels 146 with the head portions of the track. As an alternative, or perhaps in addition to possible damage caused by the false flange 154, the inward tilt of the rails may contribute to the chipping experienced at the rider rail ends. By virtue of their inward cant, the outer sides of the rails are disposed slightly higher in elevation than the inner sides thereof. Perhaps this difference in elevation is sufficient to expose the ends of the rider rails, which are bolted to the outer sides of the stationary rails 104, to damaging contact by the rolling stock wheels.

It may also be possible that some other factor plays a significant role in chipping of the rider rail ends. For instance, the present inventor has observed that rider rail end chipping is more pronounced in older bridges and bridges of less than optimum structural condition. With such bridges, there is often considerable flexure of the running rails under the weight of rolling stock. This flexure by itself or in combination with one or more of the cant of the track, the presence of false wheel flanges or some other factor(s), may be sufficient to expose the upper ends of the rider rail 110 to contact with the rolling stock wheels.

Figure 9:
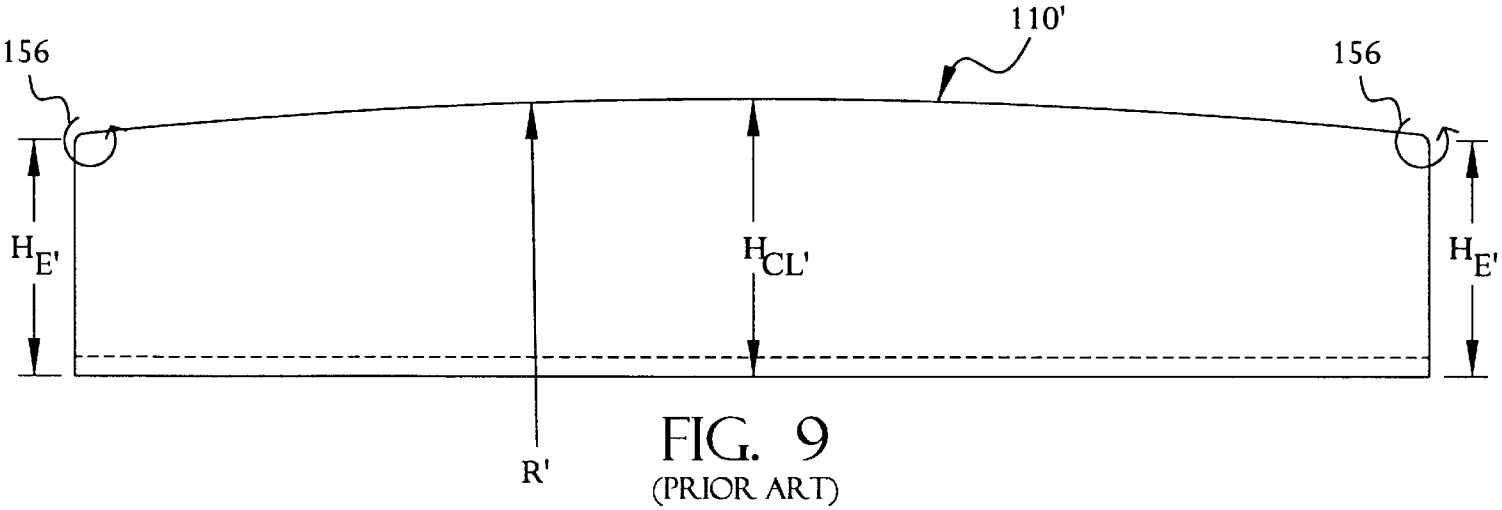
FIG. 9 (PRIOR ART)
FIG. 9 is a side elevation view of a conventional rider rail.

FIG. 9 reveals, on an enlarged and somewhat exaggerated scale, the longitudinal side profile of a conventional rider rail 110' adapted for use in a miter rail system. Rider rail 110' is typically between about 34 to about 40 inches, preferably about 37 inches, in length, and about 3 and 3¼ inches in thickness (with a base width of between about 4½ to about 5 inches). The upper surface of rider rail 100' is defined by a continuous convex arc are having a radius R' of between about 400 to 500 inches, more particularly about 450 inches. The centerline height, $H_{CL'}$, of rider rail 110' is selected to exceed the height of the running rails with which the rider rail is to be used by a predetermined distance of about 3/16 inch. For example, if 132 lb. R.E. #1 rail having a height of 7⅛ inches is chosen as the fixed and lift rails, $H_{CL}$'would be about 7 5/16 inches. The end face height, $H_{E'}$, of rider rail 110' is selected to be lower than the height of the running rails with which the rider rail is to be used by a predetermined distance of about 3/16 inch. Therefore, if 132 lb R.E. #1 rail is chosen as the fixed and lift rails, the end face height $H_{E'}$ of rider rail 110' would be about 6 15/16 inches.

Despite an end height $H_E$ as much as 3/16 inch below the adjacent running rails, rider rails constructed according to rail 110' commonly experience chipping at their upper end edges, i.e., the areas encircled by arrows 156, during usage. As offered hereinabove, such damaging chipping may arise from any one or more of several possible sources including, without limitation, the cant of the track, the existence of false flanges 154 (FIG. 8) on the outer edges of some rolling stock wheels, and the age and/or condition of the bridge.

Figure 10:
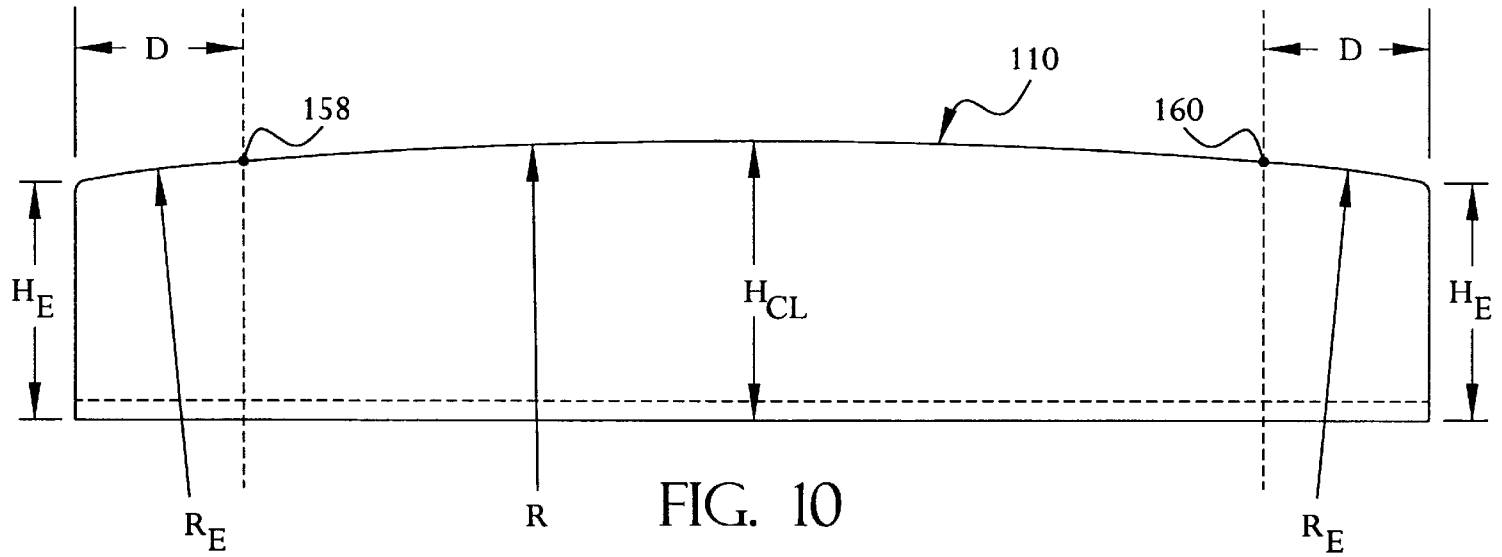
FIGS. 10–11 are side elevation views of rider rails according to the present invention.
Figure 11:
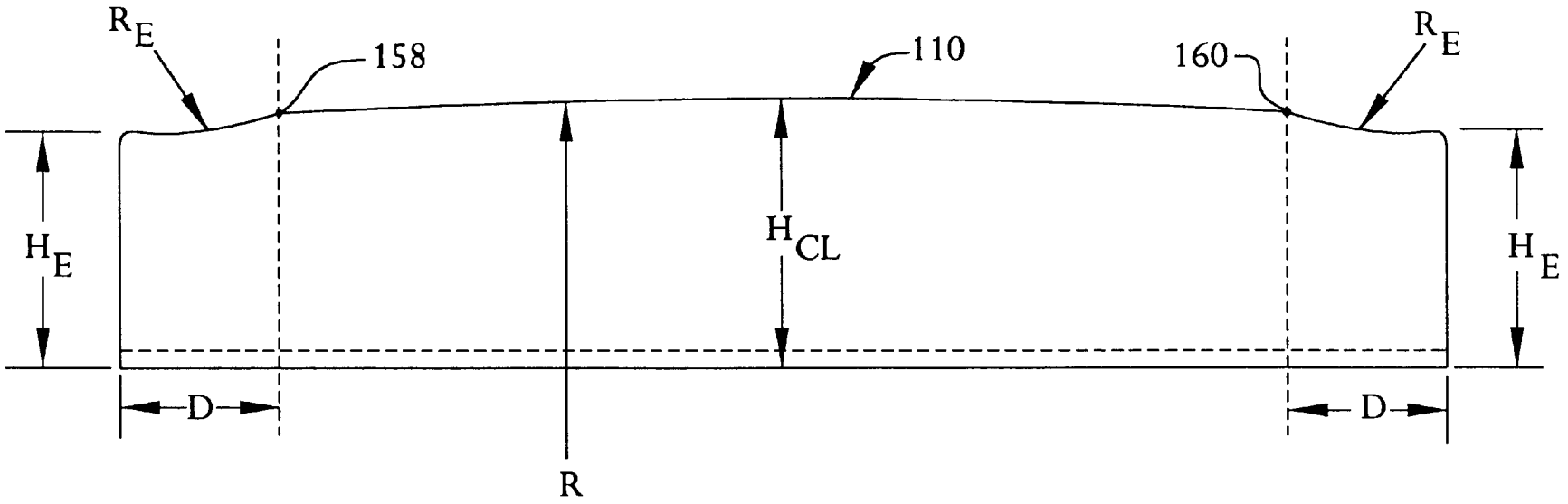

FIG. 10 illustrates, on an enlarged and somewhat exaggerated scale, the longitudinal side profile of a presently preferred embodiment of rider rail 110 according to the present invention. The length and thickness dimensions of rider rail 110 are preferably similar to those of rider 110'.

That is, rider rail 110 has a length of between about 34 to about 40 inches, preferably about 37 inches, and a width of between about 3 and 3¼ inches (with a base width of between about 4½ to about 5 inches). Unlike rider rail 110', a central portion rather than the entire upper surface of the rail is defined by a continuous arc having a radius R of between about 400 to 500 inches, more preferably about 450 inches. The centerline height, $H_{CL}$ of rider rail 110 is to be a predetermined distance, preferably about 3/16 inch, higher than the height of the running rails 102, 104.

The end face height, $H_{E'}$ is selected to be a predetermined distance, preferably about ⅜ inch, lower than the height of the chosen running rail. Thus, if 132 lb R.E. #1 rail is chosen as the running rails 102, 104, which rail has a height of 7⅛ inches, $H_{CL}$ of rider rail 110 would be about 7 5/16 inches and $H_E$ would be about 6¾ inches. Rider rails constructed according to rider rail 110 are less susceptible to the damaging effects of and chipping than conventional rider rails 110'. It is believed that the improved performance of rider rails 110 may be attributable to the lower end height $H_E$ of rider rail 110 versus end face height $H_E'$ of rider rail 110' for comparably sized running rails 102, 104.

To achieve sufficient lifting of a rolling stock wheel as it traverses rider rail 110, the geometries of the rolling stock wheel, the rider rail and the running rails must be taken into consideration. For instance, it will be assumed that a rider rail has a length of about 37 inches, a maximum height $H_{CL}$ of about 3/16 inch above a chosen running rail and a central upper surface portion defined by an arc having a radius of about 450 inches. According to the present invention, the points at which the upper surface of the rider rail 110 should intersect the upper surfaces of the running rails, identified by reference numerals 158, 160 in FIG. 10 should lie at a distance D of about 3 to about 6 inches, preferably about 4 to about 5 inches, from the end faces of the rider rail 110.

The transition through distance D from end face height $H_E$ to points 158, 160 may be achieved by providing the upper surface of the rider rail 110 with any surface contour which lowers the height of the upper surface from points 158, 160 to $H_E$ at the rider rail end faces and which does not present pronounced corners or edges at points 158, 160. For example, the desired transition may be achieved via a linear or concave sloping surface or, as illustrated, by a gentle convex sloping surface. According to a presently preferred embodiment, the convex sloping and surfaces may be achieved by machining the arc spanning distance D to a radius, $R_E$, of about 90 to about 100 inches, preferably about 95 inches. It will be understood that $R_E$ may be the same or different for each end of rider rail 110. Also, either end of the rider rail 110 may have a convex, concave or linearly sloping surface.

Although the invention has been described in detail for the purpose of illustration, it is to be understood that such detail is solely for that purpose and that variations can be made therein by those skilled in the art without departing from the spirit and scope of the invention except as it may be limited by the claims.

What is claimed is:

1. A rider rail for a miter rail system including a fixed running rail and a lift running rail, said fixed and lift running rails having a predetermined height, said rider rail comprising a rigid member having an upper surface and oppositely directed end faces, said upper surface including a convex central portion defined by a central arc of constant radius wherein the apex of said central arc is greater in height than said predetermined height and wherein said central portion extends from a first point where the height of said upper surface is substantially equal to said predetermined height and a second point where the height of said upper surface is substantially equal to said predetermined height, said upper surface further including a first end portion defined by a first arc, said first end portion extending from said first point to a rounded edge at one of said end faces, the height of which is sufficiently low to avoid contact by a rolling stock wheel, and a second end portion defined by a second arc, said second end portion extending from said second point to a rounded edge at the other of said end faces, the height of which is sufficiently low to avoid contact by a rolling stock wheel said first and second arcs having a constant radius smaller than said constant radius of said central arc.

2. The rider rail of claim 1 wherein said first end portion is convex.

3. The rider rail of claim 1 wherein said second end portion is convex.

4. The rider rail of claim 1 wherein said first end portion is concave.

5. The rider rail of claim 1 wherein said second end portion is concave.

6. The rider rail of claim 1 wherein said first and second end portions are convex.

7. The rider rail of claim 1 wherein said first and second end portions are concave.

8. The rider rail of claim 1 wherein said heights at said end faces is at least about ⅜ inch less than said predetermined height.

9. A miter rail system including a fixed running rail, a lift running rail and a rider rail, said fixed and lift running rails having a predetermined height, said rider rail comprising a rigid member having an upper surface and oppositely directed end faces, said upper surface including a convex central portion defined by a central arc of constant radius wherein the apex of said central arc is greater in height than said predetermined height and wherein said central portion extends from a first point where the height of said upper surface is substantially equal to said predetermined height and a second point where the height of said upper surface is substantially equal to said predetermined height, said upper surface further including a first end portion defined by a first arc, said first end portion extending from said first point to a rounded edge at one of said end faces, the height of which is sufficiently low to avoid contact by a rolling stock wheel, and a second end portion defined by a second arc, said second end portion extending from said second point to a rounded edge at the other of said end faces, the height of which is sufficiently low to avoid contact by a rolling stock wheel, said first and second arcs having a constant radius smaller than said constant radius of said central arc.

10. The miter rail system of claim 9 wherein said first end portion is convex.

11. The miter rail system of claim 9 wherein said second end portion is convex.

12. The miter rail system of claim 9 wherein said first end portion is concave.

13. The miter rail system of claim 9 wherein said second end portion is concave.

14. The miter rail system of claim 9 wherein said first and second end portions are convex.

15. The miter rail system of claim 9 wherein said first and second end portions are concave.

16. The miter rail system of claim 9 wherein said heights at said end faces is at least about ⅜ inch less than said predetermined height.

17. A miter rail system including a fixed running rail, a lift running rail and a rider rail, said fixed and lift running rails having a predetermined height, said rider rail comprising a rigid member having an upper surface and oppositely directed end faces and a length between said end faces of between 34 and 40 inches, a width of between 3 and 3¼ inches and a base width of between 4½ and 5 inches, said upper surface including a convex central portion defined by a central arc of constant radius of between 400 and 500 inches wherein the apex of said central arc is greater in height than said predetermined height and wherein said central portion extends from a first point where the height of said upper surface is substantially equal to said predetermined height and a second point where the height of said upper surface is substantially equal to said predetermined height, said upper surface further including a first convex end portion defined by a first arc having a constant radius of between 90 and 100 inches, said first end portion extending from said first point to one of said end faces, the height of which is sufficiently low to avoid contact by a rolling stock wheel, and a second convex end portion defined by a second arc having a constant radius of between 90 and 100 inches, said second end portion extending from said second point to the other of said end faces, the height of which is sufficiently low to avoid contact by a rolling stock wheel.

18. The miter rail system in accordance with claim 17 wherein the length between said end faces is substantially equal to 37 inches, the constant radius of said central arc is substantially equal to 450 inches, the first and second arcs each having a constant radius which is substantially equal to 95 inches, and the height of each of the first and second end faces is substantially equal to at least ⅜ inch below said predetermined height.

* * * * *